US012038243B2

(12) United States Patent
Neefs et al.

(10) Patent No.: US 12,038,243 B2
(45) Date of Patent: Jul. 16, 2024

(54) PLATE FOR A PLATE HEAT EXCHANGER

(71) Applicant: AXENS, Rueil-Malmaison (FR)

(72) Inventors: Henricus Neefs, Rueil-Malmaison (FR); Constantin Popescu, Rueil-Malmaison (FR)

(73) Assignee: AXENS, Rueil-Malmaison (FR)

( * ) Notice: Subject to any disclaimer, the term of this patent is extended or adjusted under 35 U.S.C. 154(b) by 571 days.

(21) Appl. No.: 17/281,794

(22) PCT Filed: Sep. 20, 2019

(86) PCT No.: PCT/EP2019/075267

§ 371 (c)(1),
(2) Date: Mar. 31, 2021

(87) PCT Pub. No.: WO2020/069880

PCT Pub. Date: Apr. 9, 2020

(65) Prior Publication Data

US 2021/0389060 A1 Dec. 16, 2021

(30) Foreign Application Priority Data

Oct. 1, 2018 (FR) ..... 1859077

(51) Int. Cl.

| | |
|---|---|
| ***F28F 3/00*** | (2006.01) |
| ***F28D 9/00*** | (2006.01) |
| ***F28F 3/08*** | (2006.01) |

(52) U.S. Cl.

CPC ..... *F28F 3/08* (2013.01); *F28D 9/0037* (2013.01); *F28D 9/0062* (2013.01); *F28F 2240/00* (2013.01)

(58) Field of Classification Search

CPC ..... F28F 3/08; F28F 2240/00; F28D 9/0037; F28D 9/0062

(Continued)

(56) References Cited

U.S. PATENT DOCUMENTS

2006/0131002 A1* 6/2006 Mochizuki ..... F28D 15/046 165/104.26
2011/0017436 A1 1/2011 Cho
2013/0319069 A1 12/2013 Abker et al.

FOREIGN PATENT DOCUMENTS

EP 2669027 A1 * 12/2013
EP 2669027 A1 12/2013

(Continued)

OTHER PUBLICATIONS

International Search Report dated Nov. 21, 2019 issued in corresponding PCT/EP2019/075267 application (2 pages).

*Primary Examiner* — Davis D Hwu
(74) *Attorney, Agent, or Firm* — MILLEN, WHITE, ZELANO & BRANIGAN, P.C.; Csaba Henter

(57) ABSTRACT

The invention relates to a heat exchanger plate (A; B) comprising a central panel ($A_0$; $B_0$) with at least four sides ($A_1$, $A_2$, $A_3$, $A_4$; $B_1$, $B_2$, $B_3$, $B_4$), said central panel being preferably quadrilateral, or quadrilateral with truncated corners, said plate having:

Figures 1A, 1B:
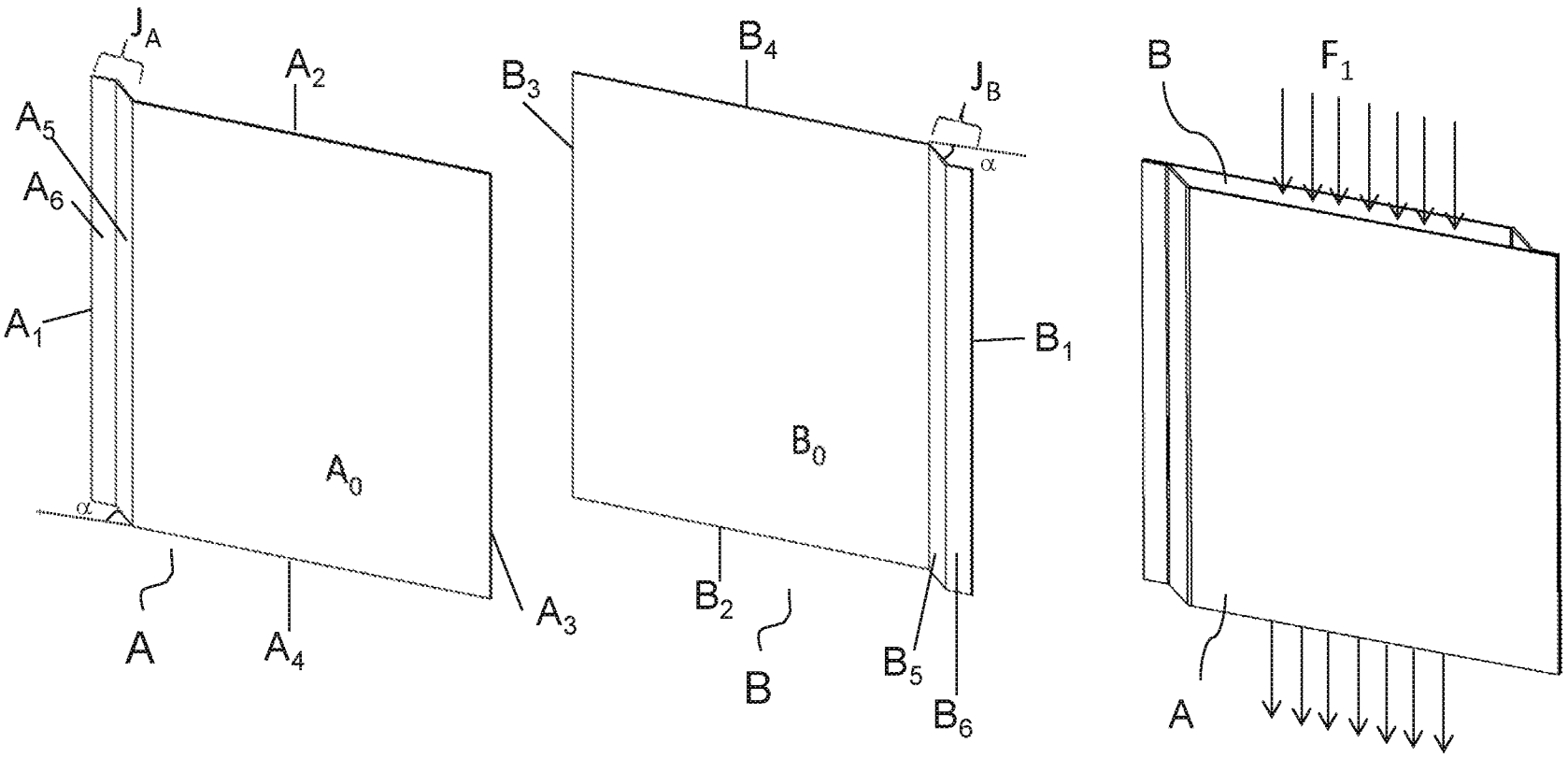

a first side ($A_1$; $B_1$) of the central panel which is inclined with respect to said central panel ($A_0$; $B_0$) and which forms a first joining panel ($J_A$; $J_B$), the opposite side ($A_3$; $B_3$) to said first side ($A_1$; $B_1$) which is flat.

20 Claims, 5 Drawing Sheets

(58) Field of Classification Search
USPC ..... 165/166
See application file for complete search history.

(56) References Cited

FOREIGN PATENT DOCUMENTS

| | | | |
|---|---|---|---|
| GB | 361780 | A | 11/1931 |
| WO | 2014/178472 | A1 | 11/2014 |

* cited by examiner

PLATE FOR A PLATE HEAT EXCHANGER

FIELD OF THE INVENTION

The invention relates to the field of plate heat exchangers used in particular for the exchange of heat between two gases, but also between two liquids or between a liquid and gas.

The heat exchangers of particular interest to the invention are gas-gas exchangers operating with large or small volumetric flow rates at relatively low pressures, for example from 0.1 to 1.5 MPa. These may be used for example in the form of air pre-heaters for furnaces or may form part of NOx reduction installations (DeNOx devices).

The purpose of the heat exchangers is to perform an exchange of heat between a fluid at high temperature and a fluid at low temperature without mixing these. Plate heat exchangers have good thermal performance because of their large heat exchange area, whilst still being compact.

Plate heat exchangers recover the heat by arranging a plurality of plates which are stacked parallel to one another at predetermined intervals. Said plates are spaced apart in such a way that the space between two adjacent plates forms a canal through which a fluid can flow. A high-temperature fluid and a low-temperature fluid are supplied to the successive canals alternately so as to perform a transfer of heat between the high-temperature fluid and the low-temperature fluid via each plate.

PRIOR ART

Patent EP165179B1 describes a plate heat exchanger characterized in that the canals are defined by the space included between press-formed quadrilateral plates. Said press-formed plates comprise two pairs of opposite edges bent over at 90° in opposite directions: one pair upward and one pair downward if considering the plates in a horizontal plane. The press-formed plates are mounted symmetrically and are combined with one another by welding along their vertical edges. In such a heat exchanger, the inlet and the outlet of each canal are identical. Each press-formed plate requires at least four bending operations in order to manufacture it.

Patent application US2010/0006274A1 describes the plate heat exchanger made up of quadrilateral plates having at least two opposite edges that are bent over with respect to the heat transfer surface. The fluid canals are defined by the space between a pair of identical plates which are positioned as a mirror image of one another. As a result, the two bent-over edges of one plate are in contact with the two bent-over edges of the symmetrical plate. Thus, the plates are bent over on at least two opposite edges.

It is an object of the invention to provide a plate heat exchanger that is improved, notably that has a plate design that guarantees a reduced number of manufacturing operations and/or a reduced manufacturing cycle time, preferably without adversely affecting the heat-transfer performance and corrosion resistance, notably the resistance to corrosion by cracking.

SUMMARY OF THE INVENTION

The heat exchanger plate according to the invention, comprising a central panel with at least four sides, said central panel preferably being quadrilateral, or quadrilateral with truncated corners, can be defined as follows:

a first side of the central panel is inclined with respect to said central panel and forms a first joining panel, the opposite side to said first side is flat.

It will be emphasised that a side that is "flat" within the meaning of the invention is to be understood in its usually accepted manner, namely that the side is entirely flat, from one end of the edge in question to the other, and therefore does not comprise any portion that might not be so and that might, for example, be inclined.

By comparison with the heat exchanger plates already known, the plate according to the invention is produced with a reduced number of operations, insofar as only one bending operation is required in order to manufacture the plate. The heat exchanger plate has a heat transfer performance similar to that of the conventional heat exchanger plates.

By comparison with the heat exchanger plates already known, a single joining panel on two successive heat exchanger plates is potentially enough to mechanically connect them.

By comparison with the heat exchanger plates already known, the corrosion resistance of the heat exchanger plate according to the invention is improved. The plate according to the invention makes it possible to maintain the wall temperature of the plate above the dew point of the fluid, while a hot gas flows at the inlet and the outlet of the canal of the heat exchanger, thereby reducing the risk of corrosion under the effect of condensed acids. In addition, the design of the inlet and of the outlet of the canal offers a geometry that exhibits a lower risk of corrosion by cracking insofar as the number of bent-over edges is reduced.

By comparison with the heat exchanger plates already known, the plate according to the invention can be welded in such a way that there is no need to compensate for the expansion of the corners of the plate and that there is no need to use a dedicated expansion device in the casing of the heat exchanger.

Advantageously, the first joining panel of the heat exchanger plate according to the invention comprises a first part, notably a single part, said first part forming an angle $\alpha$ with said central panel. In this way, the plate is very easy to manufacture.

Advantageously, the first joining panel of the heat exchanger plate according to the invention is made from a first part and from a second part extending from said first part, said first part forming an angle $\alpha$ with the central panel and said second part being parallel to the central panel. The first joining panel can be manufactured with the two parts in a single bending operation. The second part may advantageously be used to weld the first joining panel to another heat exchanger plate. Thus, the plate with a single joining panel can be manufactured in a single bending operation. As a result, the plate is very easy to manufacture and can very easily be assembled with another plate.

In both the latter instances, the angle $\alpha$ between the first part of the first joining panel and the central panel is preferably comprised between 10° and 90°, preferably between 20° and 60°, and more preferably between 30° and 50°.

According to a first embodiment of the invention, a second side of the central panel of the heat exchanger plate according to the invention may be inclined with respect to the central panel, said second side being adjacent to the first side and said second side forming a second joining panel that is inclined in the opposite direction with respect to the first joining panel. Furthermore, the opposite side to said second side may be either flat or inclined in such a way as to form a third joining panel, said third joining panel being a mirror image of said second joining panel.

In this first embodiment, the second joining panel can be used to mechanically connect the central panel of said heat exchanger plate to another heat exchanger plate.

In this first embodiment, either the opposite side to said second side is flat and the two joining panels of the heat exchanger plate according to this embodiment can be mechanically connected to two heat exchanger plates comprising two joining panels, each of the joining panels being connected to one of the two plates. Or, as an alternative, the opposite side to said second side is inclined in such a way as to form a third joining panel which is a mirror image of said second joining panel, which means to say that the opposite side to the second joining panel is inclined in the same direction as the second joining panel. The heat exchanger plate with three joining panels can be mechanically connected to two other heat exchanger plates having just a first joining panel, the first joining panel being connected to one plate and the second and third joining panels being connected to the other plate.

Advantageously, in this first embodiment of the invention, the second joining panel of the heat exchanger plate according to the invention comprises a first part, notably a single part, said first part forming an angle β with the central panel. In this way, the plate is very easy to manufacture.

Advantageously, in this first embodiment of the invention, the second joining panel of the heat exchanger plate according to the invention is made from a first part and from a second part extending from said first part, said first part forming an angle β with the central panel and said second part being parallel to the central panel. The second joining panel may be manufactured with the two parts in a single bending operation so that the plate with two joining panels can be manufactured in two bending operations. The second part of the joining panel may advantageously be used to weld the second joining panel to another heat exchanger plate. As a result, the plate is very easy to manufacture and very easy to assemble with two other plates comprising two joining panels. The third joining panel, where applicable, is a mirror image of the second joining panel and requires a third bending operation. However, the plate with three joining panels can be assembled with two plates having just a first joining panel so that overall, the manufacture of a pair of plates requires only four bending operations.

Advantageously, in the latter two instances of the first embodiment, said angle β between the first part of the second joining panel and the central panel is comprised between 10° and 120°, preferably between 20° and 110°, and more preferably between 30° and 100° or, in particular, is 45° or 90°.

Another subject of the present invention is a pair of heat exchanger plates comprising two spaced-apart heat exchanger plates as described hereinabove, namely a first and a second heat exchanger plate of which the central panels are parallel to one another, wherein

- the first joining panel of the first heat exchanger plate and the first joining panel of the second heat exchanger plate are arranged to face one another, opposite one another,
- the first joining panel of said first heat exchanger plate is fixed directly to the central panel of the second heat exchanger plate on said flat side opposite,
- the first joining panel of said second heat exchanger plate is fixed directly to the central panel of the first heat exchanger plate on said flat side opposite,
- the space between the first and second heat exchanger plates forms a first canal to receive a first fluid.

The two plates of the pair of plates according to the invention are assembled via their first joining panels. The space between the two heat exchanger plates forms the first canal to receive a first fluid. The first canal has a trapezoidal cross section that remains identical along its entire length. The velocity of the fluid is substantially constant along the entire length of the canal, and this is something that may be advantageous according to the nature of the fluids.

Because the manufacturing time for each heat exchanger plate is reduced in comparison with that of conventional heat exchanger plates, the manufacturing time for the pair of plates is also reduced.

Another subject of the present invention is a stack of pairs of heat exchanger plates, comprising two spaced-apart successive pairs of plates as described hereinabove, a first pair of heat exchanger plates and a second pair of heat exchanger plates, wherein:

- said first pair and said second pair are arranged parallel to one another,
- the space between the first and second pair of heat exchanger plates forms a second canal to receive a second fluid.
- as a preference, said second pair is identical to said first pair, or said second pair is a mirror image of said first pair.

The stack of two spaced-apart successive pairs of plates according to the invention makes it possible to form the second canal to receive a second fluid. The second canal has a cross section that varies along the length of the second canal. The velocity of the fluid varies along the length of the canal, and this is something that may be advantageous according to the nature of the fluids. The manufacturing time for each pair of heat exchanger plates is reduced in comparison with that of conventional pairs of heat exchanger plates, and so the manufacturing time for the stack of pairs of plates is also reduced.

Advantageously, the two successive pairs of the stack of pairs of plates according to the invention are connected at the sides by closure means, said closure means preferably comprising an edge bar, a C-profile or U-profile cover plate, or a flat cover plate of hexagonal or pentagonal shape.

According to a first embodiment of the invention, referred to throughout the present text as the "single joining panel" variant, the heat exchanger plates according to the invention have no second joining panel.

According to another embodiment of the invention, referred to throughout the present text as the "two joining panels" variant, the stack of pairs of heat exchanger plates as described hereinabove, said second pair preferably being identical to said first pair, comprises heat exchanger plates which are such that a second side of the central panel is inclined with respect to the central panel, said second side being adjacent to the first side, and said second side forming a second joining panel inclined in the opposite direction with respect to the first joining panel, and the opposite side to said second side is flat. The stack according to the invention is then such that:

- advantageously, the second joining panel of the second heat exchanger plate of the first pair is fixed directly to the central panel of the first heat exchanger plate of the second pair and the second joining panel of the first heat exchanger plate of the second pair is fixed directly to the central panel of the second heat exchanger plate of the first pair, as an option, either closure means may connect said two pairs at the side on the side of the second joining panels, or the corner zone at the level of the intersection between the first and the second joining panel can be formed in such a way as to mechanically connect said two pairs.

The stack of two spaced-apart successive pairs of plates according to this embodiment of the invention allows the first and the second joining panel to be used to mechanically connect the heat exchanger plates. The manufacturing time for each pair of heat exchanger plates is reduced in comparison with that of conventional pairs of heat exchanger plates, and the manufacturing time for the stack of pairs of plates is also reduced.

When the corner zone at the level of the intersection of the first and second joining panel is formed in such a way as to mechanically connect the two pairs of plates, there may be no need to use cover plates.

In the "two adjoining panels" embodiment, the stack of pairs of heat exchanger plates may advantageously comprise heat exchanger plates wherein said second joining panel of each plate of the stack comprises a first part, notably a single part, said first part forming an angle β with the central panel, or wherein said second joining panel of each plate of the stack is made up of a first part and of a second part extending from said first part, said first part making an angle β with the central panel and said second part being parallel to the central panel.

Another subject of the invention is a plate heat exchanger comprising the heat exchanger plates and/or pairs of heat exchanger plates and/or a stack of pairs of heat exchanger plates as described hereinabove, arranged inside a suitable casing.

The present invention also relates to a method for manufacturing a pair of heat exchanger plates as described hereinabove, said method comprising the following steps:

preparing two central panels, preferably quadrilateral, possibly truncated, comprising a first side and a second side adjacent to the first, for each of said central panels, bending said first side in such a way as to form a first joining panel, said first joining panel comprising a first part, notably a single part, said first part forming an angle α with the central panel, optionally, for each of said central panels, bending said second side in such a way as to form a second joining panel, said second joining panel comprising a first part, notably a single part, said first part forming an angle β with the central panel, arranging the two heat exchanger plates in such a way that their first joining panels face one another and that their central panels are parallel to one another, joining the two heat exchanger plates in such a way as to form a pair of plates, the space between the two plates forming a first fluid canal, mechanically fastening the two plates along their first joining panels.

Assembling the pair of heat exchanger plates is easy and involves a reduced number of bending operations, thereby reducing the manufacturing costs and time.

The present invention also relates to a method for manufacturing a stack of pairs of heat exchanger plates as described hereinabove, said method comprising:

preparing at least four central panels, preferably quadrilateral, possibly truncated, comprising a first side and a second side adjacent to the first, for each of said central panels, bending said first side in such a way as to form a first joining panel, said first joining panel comprising a first part, notably a single part, said first part forming an angle with the central panel, optionally, for each of said central panels, bending said second side in such a way as to form a second joining panel, said second joining panel comprising a first part, notably a single part, said first part forming an angle β with the central panel, arranging the heat exchanger plates in pairs in such a way that their first joining panels face one another by being opposite one another, and that their central panels are parallel to one another, joining the heat exchanger plates in such a way as to form at least two pairs of plates, the space between the two plates forming a first fluid canal, mechanically fastening the two plates of each pair along their first joining panels, stacking the at least two pairs of plates, the space between the pairs of heat exchanger plates forming a second fluid canal, optionally, mechanically fastening the two pairs of plates along their second joining panels.

In the "single joining panel" variant of the invention, the plates of the heat exchanger may be substantially identical, and preferably are identical, making assembly easier and reducing manufacturing costs: to form a stack of pairs, all that is required, for example, is to prepare a first pile of plates and a second pile of plates in which the plates, which are notably all identical, have been rotated through 180° and turned over. Thereafter, plates are taken from the two piles alternately in order to gradually make up the stack. The process may be automated.

In the "two adjoining panels" embodiment of the invention, the plates of the heat exchanger may be substantially similar: the second joining panel being situated alternately to one side and to the other of the first joining panel, for two plates which succeed one another in the stack of plates. Specifically, the second joining panels may thus face one another when two successive pairs have been assembled. That makes assembly easy and reduces manufacturing costs: to form a stack of pairs, all that is required, for example, is to prepare a first pile of plates of the first type and a second pile of in order to make up the stack. The process may be automated.

DESCRIPTION

Throughout the present text, the terms "supply" or "inlet" and "outlet" or "remove" and "into" or "out of" are used with reference to the direction in which the fluids flow.

Throughout the present text, the term "side" of the central panel is used with reference to the periphery of the central panel, over a certain width, for example up to 5% of the width of the plate.

Throughout the present text, the term "mirror image" refers to symmetry about a plane situated in the middle of the space separating the object from its likeness.

The invention can be used for example for plate heat exchangers operating on the cross-flow principle, in which the fluids flowing over the two faces of each plate are directed substantially perpendicular to one another. The invention can also be used for plate heat exchangers operating on a counter-current principle, in which the fluids flowing over the two faces of each plate are directed in substantially opposite directions. The invention can also be used for plate heat exchangers operating on a co-current principle, in which the fluids flowing over the two faces of each plate are directed in substantially the same direction. The invention can also be used for heat exchangers of the plate type operating using other flow principles.

The invention is particularly well suited to exchanges between two fluids, notably two gases, but may also be used for exchanges of heat between two liquids or between a liquid and gas.

The invention is more particularly suitable for exchanges between two gases, notably gas flows at the inlet and outlet of a single item of equipment, such as, for example, the air that is to be carried to a furnace and the flue gases from that same furnace or, similarly, the hot stream coming from a NOx reduction system and the cold stream heading toward the same NOx reduction system.

A plate heat exchanger according to the invention can be used for fluids operating at a pressure ranging from total vacuum pressure up to 1.5 MPa, preferably from 0.1 to 1.0 MPa, and more preferably, from 0.1 to 0.6 MPa.

A plate heat exchanger according to the invention may be made up either of channels of uniform height or of channels with different heights on each circuit. Correspondingly, the height of the first joining panel and the heights of the second and of the third joining panel, where applicable, may be similar or different.

The height of the channels (the spacing between two consecutive plates) can be determined according to the service conditions. Typically, it may range from 5 to 30 mm, notably being 5 mm, 10 mm, 15 mm, 20 mm, 30 mm, or any appropriate height.

The width of the heat exchanger plate according to the invention may typically be comprised between 1000 mm and 2000 mm, preferably between 1300 mm and 1700 mm. The length of the heat exchanger plate according to the invention may typically be comprised between 1000 mm and 7500 mm, preferably between 1500 mm and 7000 mm. The thickness of the plate may be comprised between 0.6 mm and 6 mm, preferably between 1.5 mm and 2.0 mm.

The central panel of the heat exchanger plate according to the invention may have any suitable shape, for example trapezoidal, hexagonal or quadrilateral. The central panel is more preferably quadrilateral, notably rectangular or square, possibly with truncated corners.

The central panel comprises a first face (or lower face) and a second face (or upper face) opposite to the first face. The first and second faces may be planar but may also locally comprise reliefs, ribs or protrusions.

Advantageously, protrusions (dimples) may be added to or pressed into the central panel of the plates. Dimples may be employed on one face of the plate or on both faces of the plate, with a number of arrangements according to the characteristics of the plate and the purpose of said dimples. The dimples may be used by way of spacer elements and are intended to minimize the deformations of the plates when stacked on top of one another. Simple or double dimples are typically distributed over the surface of the central panel of the heat exchanger plates.

Fins shaped as a hairpin or as a pin ("pin fins") may also possibly be welded to the central panel of the heat exchanger plate according to the invention, using resistance welding.

According to one preferred embodiment of the invention, the heat exchanger according to the invention is such that:

- the first canal is situated between the two heat exchanger plates of a single pair of plates according to the invention. Said two plates are mechanically connected via their first joining panels on each side. The first canal has a cross section that is trapezoidal, and said cross section retains the same dimensions along the entire length of the canal. The fluid enters the canal directly at a given velocity. The flow velocity of the fluid is then constant along the entire length of the canal. The fluid also leaves at the same velocity. The first canal is therefore said to have "direct" ("bluff") inlet and outlet zones, unlike the second canal.
- by contrast, the second canal is situated between two spaced-apart successive pairs of two plates. The cross section of the canal is not constant over the entire length of the canal. Specifically, a cross section of the second canal shows that the inlet and outlet zones are larger than the rectangular central section of the canal. As a result, the velocity of the fluid varies along the length of the second canal: it increases when the cross section of the canal decreases in the first part of the canal (the inlet) and it decreases when the cross section of the canal increases in the last part of the canal (the outlet). As a result, the second canal is therefore said to have "sharp" inlet and outlet zones, unlike the first canal.

In the remainder of the present text, the first canal with the "direct" or "bluff" inlet and outlet is referred to as the "bluff canal" and the second canal with the "sharp" inlet and outlet is referred to as the "sharp canal".

According to a first mode of operation of the invention, the hot fluid that is to be processed in the heat plate heat exchanger on the hot side may be sent into the "bluff canals" and the cold fluid that is to be processed on the cold side may be sent into the "sharp canals".

According to a second mode of operation of the invention, the cold fluid that is to be processed in the heat plate heat exchanger on the cold side may be sent into the "bluff canals" and the hot fluid that is to be processed on the hot side may be sent into the "sharp canals".

When the hot fluid is flowing in the "bluff canal", the profile of the heat exchanger plate encourages vapor of the hot fluid to condense. By contrast, when the hot fluid is flowing in the "sharp canal", the profile of the heat exchanger plate encourages the hot fluid not to condense.

Advantageously, closure means may be used where applicable to close the lateral sides of the second canal and to seal the canal. Advantageously, said closure means may be mechanically connected to the plates by any means known to those skilled in the art, for example by welding, notably by seam welding or by bolting.

In a stack of pairs of plates according to the "single joining panel" variant, in which the heat exchanger plates have no second joining panel, the second canal is advantageously provided with means for closing its lateral side between two successive pairs of plates. Said closure means may be edge bars or cover plates (cover parts) or any equivalent means. The cover plates may be manufactured in a single or in several pieces, some in the shape of a C or of a U or of any arbitrary profile that allows the second plate of the first pair to be assembled with the first plate of the second pair. The shape of the cover plate may also be octagonal so that it conforms in a single piece to the cross section of the second canal. Closure means may be provided longitudinally in the direction of flow of the second fluid at the level of the inlet and of the outlet of the second canal.

In a stack of pairs of plates according to the "two joining panels" variant, in which heat exchanger plates have two joining panels, the successive pairs are assembled via the second joining panel of the second plate of the first pair on one side and via the second joining panel of the first plate of the second pair on the other side.

In that case, either closure means may advantageously be provided, running longitudinally in the direction of flow of the second fluid at the level of the inlet and at the level of the outlet of the second canal. Said closure means may preferably be a polygonal cover plate of quadrilateral or pentagonal shape.

Or, the corner zone at the level of the intersection between the first and second joining panels may advantageously be press-formed or formed in some other way so that said corner zone is used for mechanically connecting the second plate of the first pair and the first plate of the second pair so that there is no need to use closure means. Typically, said corner zone may be stamped, embossed, pressed, hammered and enlarged enough that it can be welded to the panels of adjacent plates.

The first and second canals, notably the second canal, may be either completely empty (free canal) or may comprise any type of reinforcing element such as connecting bars.

Advantageously, spacer elements (spacers) manufactured for example from strips, profiles, dimples or pin fins may be inserted into the canal to ensure the spacing between the plates. They may be loose or may be spot welded in place or may be held in place by profiled U-shaped clamps at the supply and discharge points.

Advantageously, the first and second joining panels, which comprise a part, notably a single part, or which are manufactured from two parts, are made of plates that are flat or substantially flat.

According to one preferred embodiment of the invention, the first joining panel or the second joining panel may be mechanically fixed to the central panel of the adjacent plate by any possible technique, typically by welding.

Advantageously, the second part of the first and/or of the second joining panel may be large enough to allow mechanical fixing of the second part to the central panel of the adjacent plate by any means known to those skilled in the art.

In a first variant, the second joining panel may be oriented downward with respect to the plane of the central panel at an angle β comprised between 10° and 90°, preferably between 20° and 60°, and more preferably between 30° and 50°.

In a second variant, the second joining panel may be oriented downward with respect to the plane of the central panel at an angle β comprised between 60° and 120°, preferably between 70° and 110°, and more preferably between 80° and 100°.

As a variant, the second part of the second joining panel may extend from the first part of the second joining panel parallel to the plane of the central panel, said second part being either oriented toward the inside of the canal or toward the outside of the canal.

Each of the first, second or third joining panel may preferably be formed in a single step, by deformation. The deformation may be obtained by press-forming and/or by bending.

In another embodiment of the invention, different zones of the heat exchanger central panel may be provided with a layer of insulation made of a part made of metal plate parallel to the central panel, with air between the metal-plate part and the central panel. Said layer of insulation may allow the wall temperature of the heat exchanger plate to be locally modified. Said layer of insulation may typically be employed in the coldest zones of the cold canal and is described for example in patent CZ298773B6.

According to another embodiment of the pair of two heat exchanger plates according to the invention, an end piece or "ferrule" may be mounted over the top of the edges of the two adjacent plates welded together, and act as a shield protecting the join. The ferrule is typically made from a piece of sheet metal bent in such a way as to be able to cover the welded join. The ferrule may be welded to each of the two plates.

The heat exchanger plate according to the invention may be formed of a single piece, usually by a single-step deformation of a flat metal sheet made of a weldable material, for example steel plate or stainless steel plate. The first and, where applicable, the second and third joining panel may form part of the central panel or may also be fixed thereto. In the "two joining panels" variant, a second step in the deforming of the flat metal sheet may be required in order to form the second lateral joining panel. The deformations may be obtained by press-forming and/or by bending. The heat exchanger plate according to the invention may also be manufactured by assembling several independent plate parts.

DETAILED DESCRIPTION

Further features and advantages will become apparent from reading the following description provided purely by way of nonlimiting illustration, which is to be read with reference to the attached figures, in which:

FIG. 1*a* depicts two identical heat exchanger plates A and B according to the "single joining panel" variant, in which the heat exchanger plates have no second joining panel, and FIG. 1*b* depicts the corresponding pair of plates according to the invention when said plates A and B have been assembled.

Figure 2B:
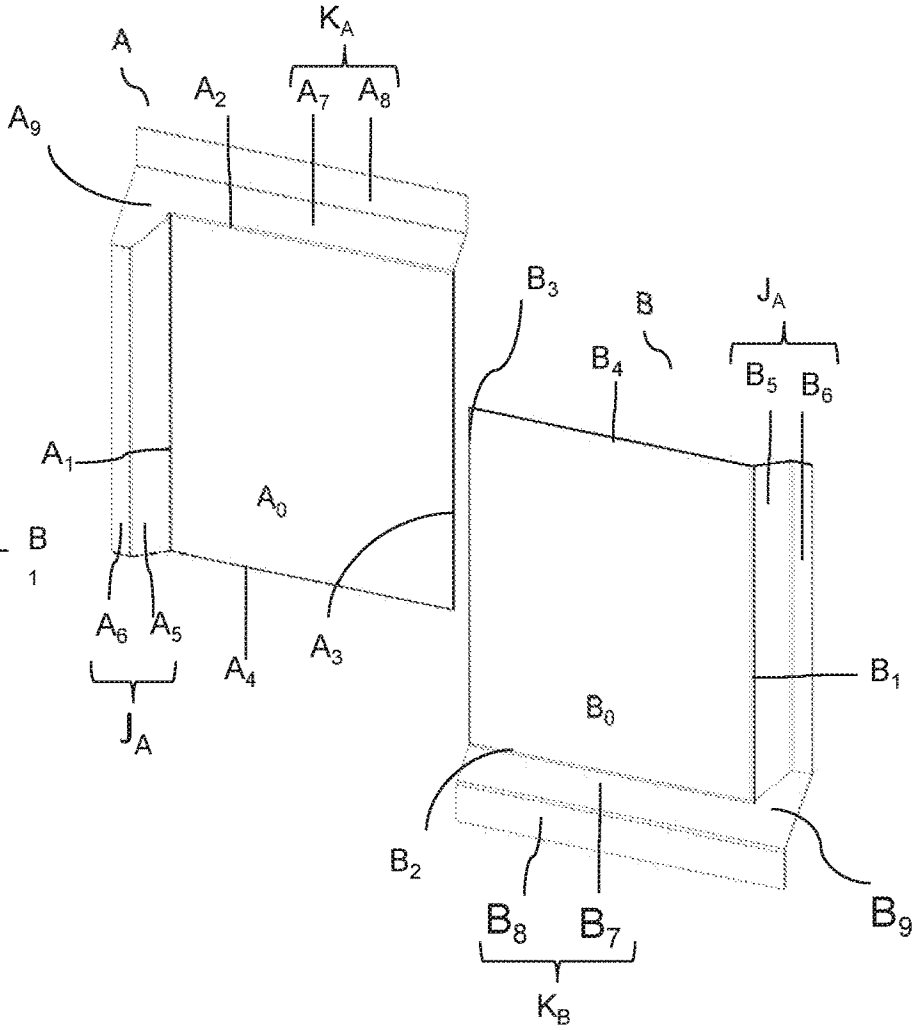
Figure 2A:
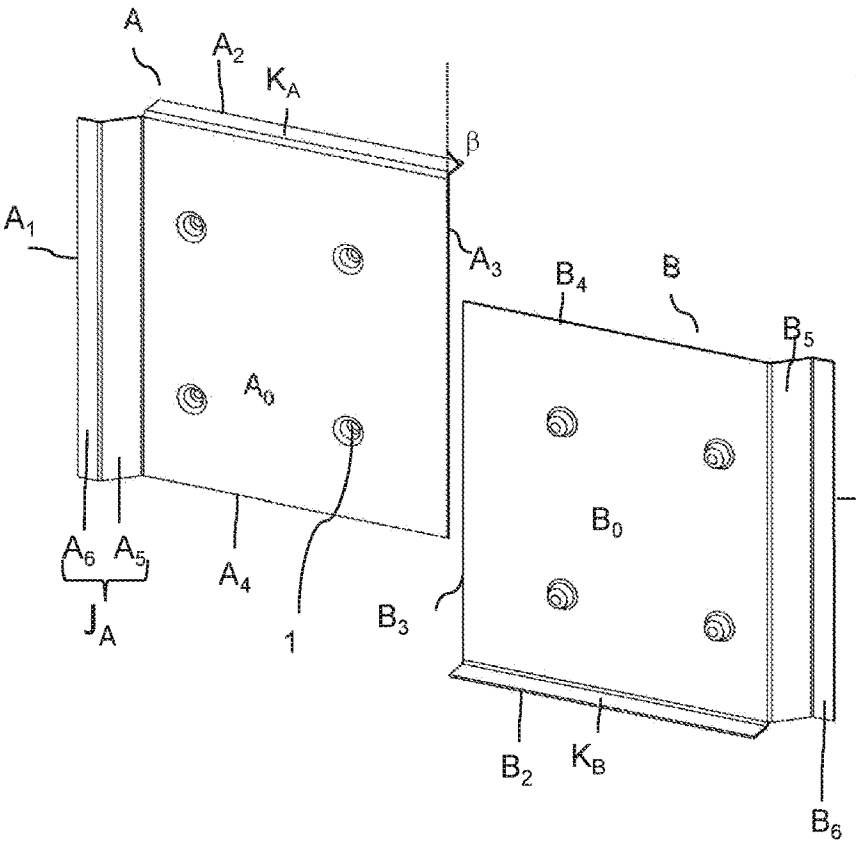

FIGS. 2*a* and 2*b* depict two plates A and B according to the "two joining panels" variant, in which said plates have a first and a second joining panel, according to two different embodiments.

Figure 3B:
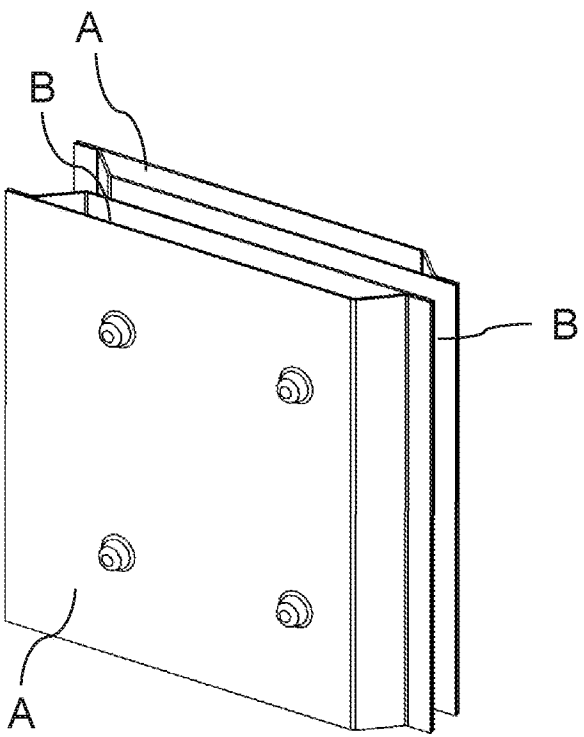
Figure 3A:
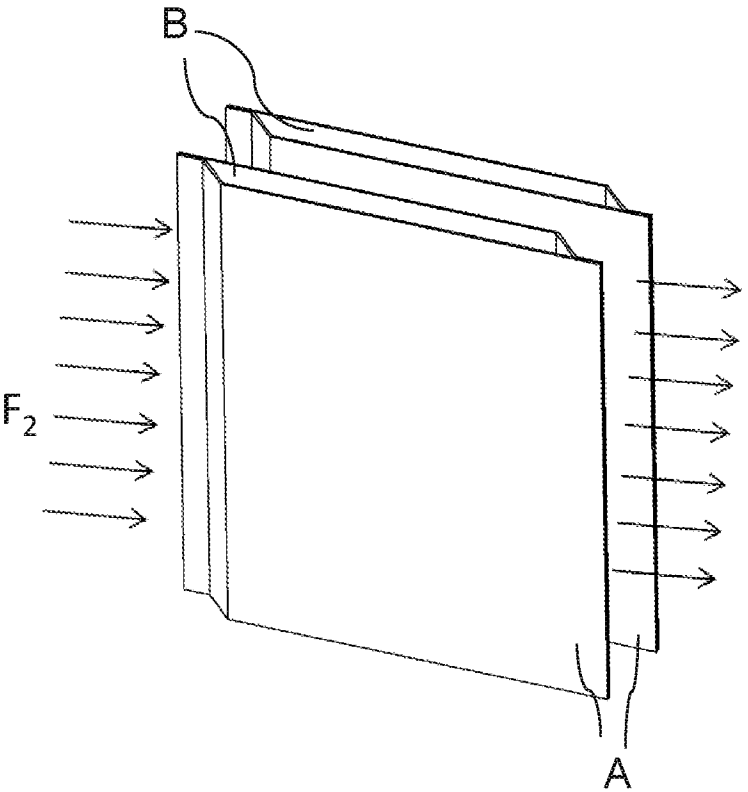

FIG. 3*a* depicts a stack of two pairs of heat exchanger plates according to a first embodiment, and, in FIG. 3*b*, according to a second embodiment of the invention.

Figure 4B:
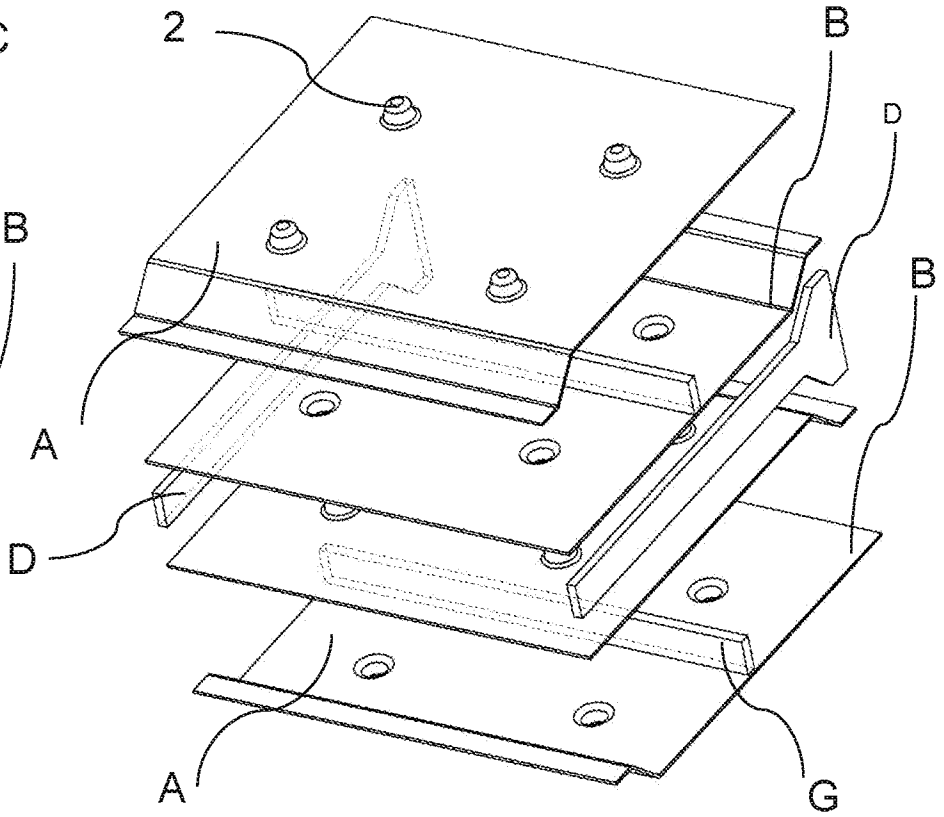
Figure 4A:
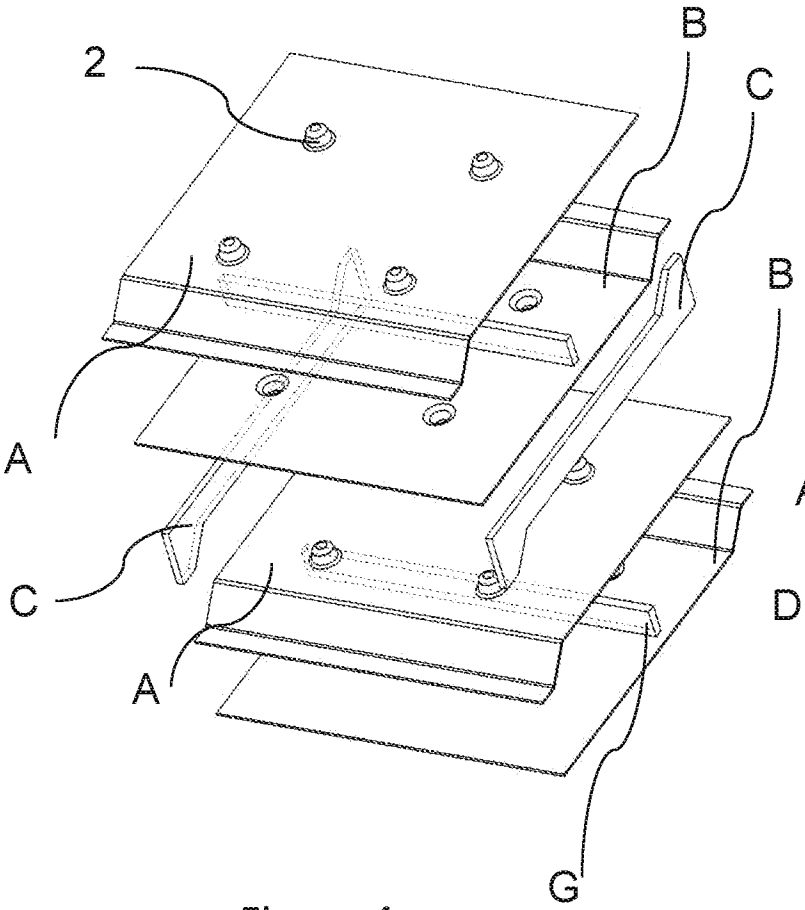

FIGS. 4*a* and 4*b* depict an exploded view of a stack of pairs of heat exchanger plates similar to those of FIGS. 3*a* and 3*b*, but also illustrating cover plates and spacer bars.

Figure 5:
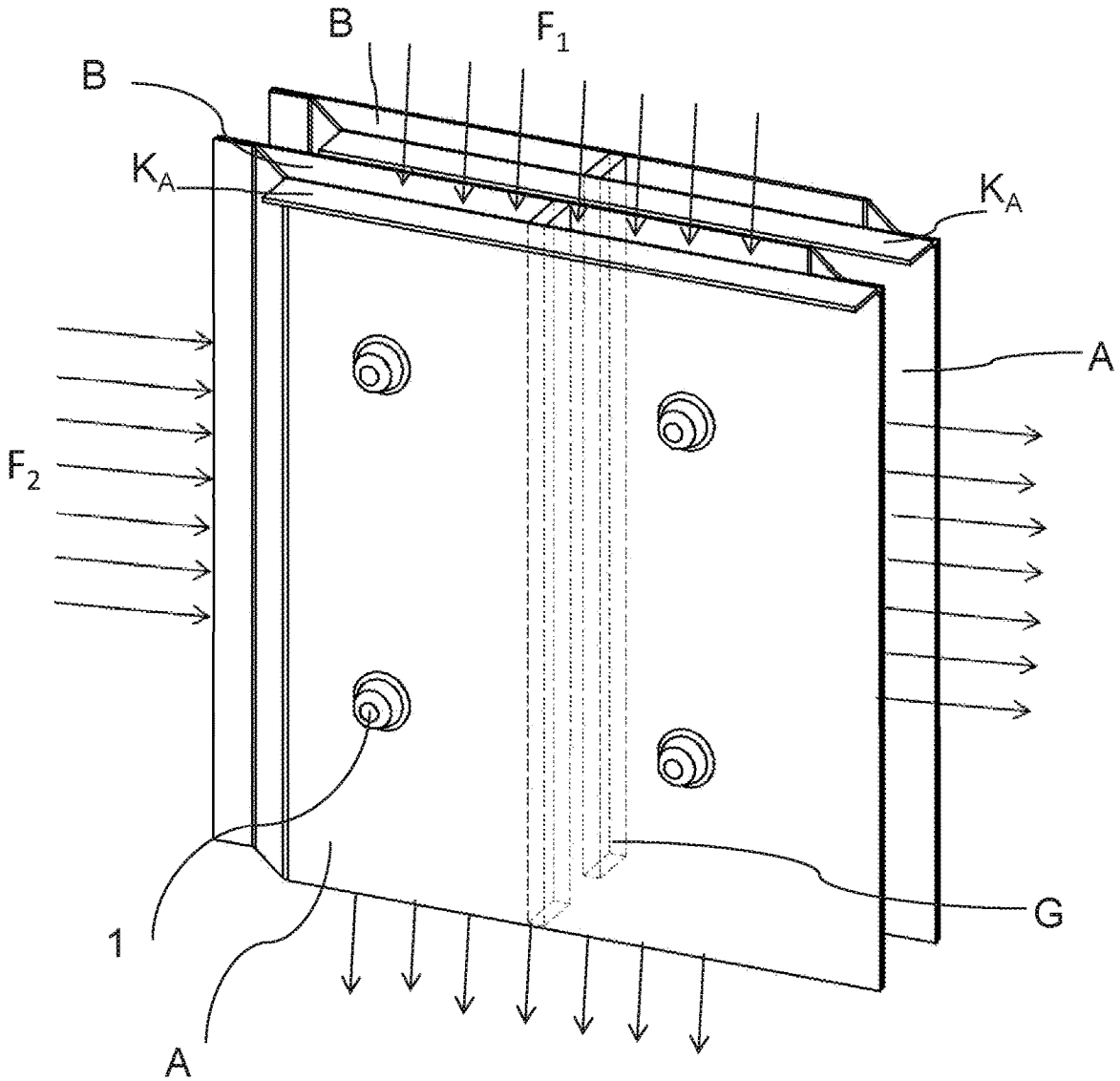

FIG. 5 depicts a stack of two pairs of heat exchanger plates according to one embodiment of the invention, in the "two joining panels" variant.

The sake of clarity, the figures do not necessarily depict the plates in the spatial position in which they can be assembled or used.

The reference symbols used in the figures are given hereinbelow with reference to the components to which they refer:

A—Heat exchanger plate A
B—Heat exchanger plate B
$A_0$—Central panel of plate A
$B_0$—Central panel of plate B
$A_1$, $A_2$, $A_3$, $A_4$—sides of central panel $A_0$
$B_1$, $B_2$, $B_3$, $B_4$—sides of central panel $B_0$
$J_A$—first joining panel of central panel $A_0$
$J_B$—first joining panel of central panel $B_0$
$A_5$—first part of first joining panel $J_A$
$A_6$—second part of first joining panel $J_A$
$B_5$—first part of first joining panel $J_B$ of central panel $B_0$
$B_6$—second part of first joining panel $J_B$
$K_A$—second joining panel of central panel $A_0$
$K_B$—second joining panel of central panel B $A_7$—first part of second joining panel $K_A$ $A_8$—second part of second joining panel $K_A$ $B_7$—first part of second joining panel $K_B$ $B_8$—second part of second joining panel $K_B$ $A_9$—corner zone at the intersection between the first and the second joining panel $J_A$ and $K_A$ $B_9$—corner zone at the intersection between the first and the second joining panel $J_B$ and $K_B$.

The references of the components depicted remain the same from one figure to another.

FIG. 1*a* depicts two identical heat exchanger plates A and B according to the "single joining panel" variant, in which the heat exchanger plates have no second joining panel. The central panel $A_0$ is rectangular and has 4 sides numbered, in the clockwise direction, $A_1$, $A_2$, $A_3$ and $A_4$. For the sake of conciseness, all the parts of the plate B are numbered in the same way.

A first side $A_1$ of the central panel is inclined with respect to the central panel and forms a first joining panel $J_A$. The side $A_3$ of the central panel situated opposite to the first joining panel $J_A$ is a flat edge. In the embodiment illustrated in FIG. 1*a*, the first joining panel $J_A$ is formed of two parts, a first part $A_5$ forming an angle $\alpha$ with the central panel and a second part $A_6$ which is parallel to the central panel plate. The first joining panel $J_A$ is connected by the fold line to the central panel, but could also have been supplied as a second component and have been fixed to the central panel. The first, two-part, joining panel is preferably formed in a single pass, by deformation. The first joining panel $J_A$ is oriented downward at an angle of approximately 45° with respect to the plane of the central panel $A_0$.

The heat exchanger plate B is identical to A and is positioned symmetrically with respect to A with respect to the point situated at the center of the space between plate A and plate B. That means that plate B has been set down after having been turned over and turned through 180°, the first joining panels of plates A and B facing one another.

FIG. 1*b* illustrates a schematic perspective view of the way in which the two plates A and B of FIG. 1*a* are assembled and mechanically connected to form a pair of heat exchanger plates according to one embodiment of the invention.

The two plates of FIG. 1*a* have been superposed so that they can be mechanically connected. The "lower face" of plate A faces the "lower face" of plate B. The first joining panel $J_A$ of plate A faces the first joining panel $J_B$ of plate B. The second part $A_6$ of the first joining panel $J_A$ of plate A is welded to the flat side $B_3$ of the central panel of heat exchanger plate B. Similarly, the second part $B_6$ of the first joining panel $J_B$ of plate B is welded to the flat side $A_3$ of the central panel of heat exchanger plate A.

The canal formed between plate A and plate B constitutes the first canal of the heat exchanger made up of the plates according to the invention, in which a first fluid $F_1$ can flow. The first canal has a flow cross section that is trapezoidal, and said cross section is the same along the entire length of the canal.

FIGS. 2*a* and 2*b* depict a perspective view of two plates A and B according to the "two joining panels" variant, in which the heat exchanger plates have a second joining panel, according to two different embodiments.

FIG. 2*a* depicts two heat exchanger plates A and B in a first embodiment of the "two joining panels" variant. The plates A and B are substantially identical with a second side of their central panel $A_0$ or $B_0$, respectively, which is inclined with respect to the central panel, on a side, $A_2$ or $B_2$, respectively, adjacent to the first joining panel, and which forms a second joining panel $K_A$ and $K_B$, respectively. Nevertheless, it will be noted that the second joining panels $K_A$ and $K_B$ of the plates A and B are situated on opposite adjacent sides, with respect to the first respective joining panels $J_A$ and $J_B$. Thus, plate B is a symmetrical image of plate A about a central line of symmetry with respect to the point situated at the center of the space delimited by the plates A and B, which means that they can easily be combined in pairs. The second joining panels $K_A$ and $K_B$ are made of a single part $A_7$ or $B_7$ which makes an angle of 90° with the central panel (perpendicular to the plane of the central panel). The second joining panels are preferably formed in a single pass, by deformation. The deformation may be obtained by press-forming and/or by bending. Furthermore, the heat exchanger plates A and B are equipped with dimples 1 which may be positioned differently on plate A and on plate B.

FIG. 2*b* depicts two heat exchanger plates A and B in a second embodiment of the "two joining panels" variant. Plates B and A are chiefly similar to plates A and B of FIG. 2*a* but the second joining panels $K_A$ and $K_B$ are made in two parts, the first part $A_7$ and $B_7$, respectively, and the second part $A_8$ and $B_8$, respectively. The first part $A_7$ or $B_7$ is connected by a bend line to the central panel along the edge $A_2$ or $B_2$, respectively, and forms an angle of approximately 45° with the central panel. The second part $A_8$ or $B_8$ is parallel to the plane of the central panel. Another difference compared with FIG. 2*a* is that the corner zones $A_9$ and $B_9$ at the level of the intersection between the first and second joining panels $J_A$ and $K_A$, $J_B$ and $K_B$, respectively, have not been cut off. Rather, said corner zones $A_9$ and $B_9$ have been formed in such a way that there is no need to use cover plates when the two plates are assembled in pairs.

FIGS. 3*a* and 3*b* depict a stack of two pairs of heat exchanger plates according to a first embodiment, and a second embodiment of the invention.

FIG. 3*a* depicts a first embodiment of a stack of two spaced-apart pairs of heat exchanger plates, each pair being similar to the pair of plates A and B which is depicted in FIG. 1*b*. In this embodiment, two identical pairs of two plates have been superposed. The canal formed between the first and the second pair constitutes the second canal of the heat exchanger, which is able to receive a second flow of fluid $F_2$. The cross section of the second canal is not constant over the length of the canal. Specifically, the second fluid $F_2$ first of all enters a rectangular volume, then a trapezoidal volume, and then another rectangular volume. On leaving the canal, the situation is reversed: the second fluid enters a trapezoidal volume, then a rectangular volume.

FIG. 3*b* depicts another embodiment of the stack of two spaced-apart pairs of heat exchanger plates, each pair being similar to the pair of plates that is depicted in FIG. 1*b*, but one of the two pairs has been turned over in order to obtain a second pair which is a mirror image of the first pair. The canal formed between the first and the second pair constitutes the second canal of the heat exchanger, which is able to receive a second flow of fluid. The cross section of the canal is not constant and differs from the cross section of the canal formed in FIG. 3*a*. The heat exchanger plates are equipped with dimples 1, but could as an alternative also use, for example, U-profiles or strips.

FIGS. 4*a* and 4*b* depict an exploded view of assemblies similar to those of FIGS. 3*a* and 3*b*, illustrating cover plates and spacer bars. All of the heat exchange plates are equipped with double dimples 2.

FIG. 4*a* illustrates the two cover plates C which are used for mechanically connecting the two successive pairs of plates, arranged in a similar way to the pairs depicted in FIG. 3*a*. The cover plates C are octagons having the same cross-sectional shape as the second canal. The cover plates C may be welded to the plate B and to the plate A or may be attached using any mechanical means. Lateral spacer bars G are produced in the first canal formed between the plates A and B. The spacer bars could also have been employed in the second canal.

FIG. 4*b* illustrates the two cover plates D which are used for mechanically connecting the two successive pairs of plates, arranged in a similar way to the pairs depicted in FIG. 3*b*. The cover plates D are octagons having the same cross-sectional shape as the second canal. The cover plates D may be welded to the plate A and B or may be attached using any mechanical means. Spacer bars G are employed in the first canal formed between the plates A and B.

FIG. 5 depicts a stack of two pairs of heat exchanger plates according to the invention, in the "two joining panels" variant. Each pair is made up of a plate A and a plate B which are similar to the plates depicted in FIG. 2*a*. The plates A and B have been assembled and mechanically connected via their first joining panel. Between plate A and plate B there is formed a first canal capable of receiving a first fluid $F_1$. Spacer bars G are employed in the first canal. Two identical spaced-apart pairs of plates are superposed and mechanically connected by their second joining panels. The canal formed between the first and the second pair constitutes the second canal of the heat exchanger, which is able to receive a second flow of fluid $F_2$. The cross section of the second canal is not constant over the length of the canal. The closure means on each side of the second canal have not been depicted.

The invention claimed is:

1. A heat exchanger plate (A; B) comprising a central panel ($A_0$; $B_0$) with at least four sides ($A_1$, $A_2$, $A_3$, $A_4$; $B_1$, $B_2$, $B_3$, $B_4$), wherein:

a first side ($A_1$; $B_1$) of the central panel is inclined with respect to said central panel ($A_0$; $B_0$) and forms a first joining panel ($J_A$; $J_B$), the opposite side ($A_3$; $B_3$) to said first side ($A_1$; $B_1$) is flat, the opposite side to said first side is entirely flat from one end of an edge to the other, and is deprived of any portion that is inclined, and a single joining panel is able to mechanically connect two successive heat exchanger plates, wherein at least one of the following a), b) or c) is satisfied a) said first joining panel ($J_A$; $J_B$) is made from a first part ($A_5$; $B_5$) and from a second part ($A_6$; $B_6$) extending from said first part, said first part forming an angle ($\alpha$) with the central panel ($A_0$; $B_0$) and said second part being parallel to the central panel;

b) said first joining panel ($J_A$; $J_B$) comprises a first part, notably a single part, said first part forming an angle ($\alpha$) with said central panel, and said angle ($\alpha$) between the first part ($A_5$; $B_5$) of the first joining panel and the central panel ($A_0$; $B_0$) is 10° to 90°;

c) a second side ($A_2$; $B_2$) of the central panel ($A_0$; $B_0$) is inclined with respect to the central panel, said second side being adjacent to the first side ($A_1$; $B_1$) and said second side forms a second joining panel ($K_A$; $K_B$) inclined in the opposite direction with respect to the first joining panel ($J_A$; $J_B$), and the opposite side ($A_4$; $B_4$) to said second side ($A_2$; $B_2$) is either flat or inclined in such a way as to form a third joining panel, said third joining panel being a mirror image of said second joining panel.

2. The heat exchanger plate (A; B) as claimed in claim 1, wherein said first joining panel ($J_A$; $J_B$) comprises a first part, notably a single part, said first part forming an angle ($\alpha$) with said central panel.

3. The heat exchanger plate (A; B) as claimed in claim 1, wherein said first joining panel ($J_A$; $J_B$) is made from a first part ($A_5$; $B_5$) and from a second part ($A_6$; $B_6$) extending from said first part, said first part forming an angle ($\alpha$) with the central panel ($A_0$; $B_0$) and said second part being parallel to the central panel.

4. The heat exchanger plate (A; B) as claimed in claim 2, wherein said angle ($\alpha$) between the first part ($A_5$; $B_5$) of the first joining panel and the central panel ($A_0$; $B_0$) is 10° to 90°.

5. The heat exchanger plate (A; B) as claimed in claim 1, wherein:

a second side ($A_2$; $B_2$) of the central panel ($A_0$; $B_0$) is inclined with respect to the central panel, said second side being adjacent to the first side ($A_1$; $B_1$) and said second side forms a second joining panel ($K_A$; $K_B$) inclined in the opposite direction with respect to the first joining panel ($J_A$; $J_B$), and the opposite side ($A_4$; $B_4$) to said second side ($A_2$; $B_2$) is either flat or inclined in such a way as to form a third joining panel, said third joining panel being a mirror image of said second joining panel.

6. The heat exchanger plate (A; B) as claimed in claim 5, wherein said second joining panel ($A_7$) comprises a first part, notably a single part ($A_7$; $B_7$), said first part forming an angle ($\beta$) with the central panel.

7. The heat exchanger plate (A; B) as claimed in claim 6, wherein said second joining panel ($A_7$) is made from a first part ($A_7$; $B_7$) and from a second part ($A_8$; $B_8$) extending from said first part, said first part forming an angle ($\beta$) with the plane of the central panel ($A_0$; $B_0$) and said second part being parallel to the central panel.

8. The heat exchanger plate (A; B) as claimed in claim 6, wherein said angle ($\beta$) between the first part ($A_7$; $B_7$) of the second joining panel and the central panel ($A_0$; $B_0$) is 10° to 120°.

9. A pair of heat exchanger plates (A, B) comprising two spaced-apart heat exchanger plates, each of which two spaced-apart heat exchanger plates independently is a heat exchanger plate (A; B) comprising a central panel ($A_0$; $B_0$) with at least four sides ($A_1$, $A_2$, $A_3$, $A_4$; $B_1$, $B_2$, $B_3$, $B_4$), wherein:

a first side ($A_1$: $B_1$) of the central panel is inclined with respect to said central panel ($A_0$; $B_0$) and forms a first joining panel ($J_A$; $J_B$), the opposite side ($A_3$; $B_3$) to said first side ($A_1$; $B_1$) is flat, the opposite side to said first side is entirely flat from one end of an edge to the other, and is deprived of any portion that is inclined, and a single joining panel is able to mechanically connect two successive heat exchanger plates;

which two spaced-apart heat exchanger plates are designated first (A) and second (B) heat exchanger plates, of which the central panels ($A_0$; $B_0$) are parallel to one another, wherein:

the first joining panel ($J_A$) of said first heat exchanger plate (A) and the first joining panel ($J_B$) of said second heat exchanger plate (B) are arranged to face one another, the first joining panel ($J_A$) of said first heat exchanger plate (A) is fixed directly to the central panel ($B_0$) of said second heat exchanger plate (B) on said opposite flat side ($B_3$), the first joining panel ($J_B$) of said second heat exchanger plate (B) is fixed directly to the central panel ($A_0$) of said first heat exchanger plate (A) on said opposite flat side ($A_3$), and the space between said first (A) and second (B) heat exchanger plates forms a first canal to receive a first fluid flow ($F_1$).

10. A stack of pairs of heat exchanger plates comprising two successive pairs of spaced-apart heat exchanger plates, each of which spaced-apart heat exchanger plates independently is a heat exchanger plate (A; B) comprising a central panel ($A_0$; $B_0$) with at least our sides ($A_1$, $A_2$, $A_3$, $A_4$; $B_1$, $B_2$, $B_3$, $B_4$), wherein:

a first side ($A_1$; $B_1$) of the central panel is inclined with respect to said central panel ($A_0$; $B_0$) and forms a first joining panel ($J_A$; $J_B$), the opposite side ($A_3$; $B_3$) to said first side ($A_1$; $B_1$) is flat, the opposite side to said first side is entirely flat from one end of an edge to the other, and is deprived of any portion that is inclined, and a single joining panel is able to mechanically connect two successive heat exchanger plates;

which spaced-apart heat exchanger plates are designated first pair of heat exchanger plates and the second pair of heat exchanger plates, wherein:

said first pair and said second pair are arranged parallel to one another, and the space between the first and second pairs of heat exchanger plates forms a second canal to receive a second fluid flow.

11. The stack of pairs of heat exchanger plates (A, B) as claimed in claim 10, forming a second canal to receive a second fluid flow, wherein said two successive spaced-apart pairs are connected at the sides by closure (C; D).

12. The stack of pairs of heat exchanger plates (A, B) as claimed in claim 10, comprising heat exchanger plates such that a second side ($A_2$, $B_2$) of their central panel is inclined with respect to the central panel ($A_0$, $B_0$), said second side ($A_2$, $B_2$) being adjacent to the first side ($A_1$, $B_1$) and said second side forming a second joining panel ($K_A$; $K_B$) that is inclined in the opposite direction with respect to the first joining panel ($J_A$; $J_B$), and the opposite side ($A_4$; $B_4$) to said second side ($A_2$; $B_2$) being flat, wherein:

the second joining panel of the second heat exchanger plate of the first pair is fixed directly to the central panel of the first heat exchanger plate of the second pair and the second joining panel of the first heat exchanger plate of the second pair is fixed directly to the central panel of the second heat exchanger plate of the first pair, and as an option, either closures connect said two pairs at the side on the side of the second joining panels, or the corner zone at the intersection between the first and the second joining panel is formed in such a way as to mechanically connect said two pairs.

13. The stack of pairs of heat exchanger plates as claimed in claim 12, comprising heat exchanger plates wherein said second joining panel of each plate of the stack comprises a part, notably a single part, said part forming an angle (β) with the central panel, or wherein said second joining panel of each plate of the stack is made up of a first part and of a second part extending from said first part, said first part making an angle (β) with the central panel and said second part being parallel to the central panel.

14. A plate heat exchanger comprising heat exchanger plates as claimed in claim 1 and/or pairs of said heat exchanger plates or stacks of pairs of said heat exchanger plates, said plates or pairs or stacks being arranged in a casing.

15. A method for manufacturing a pair of heat exchanger plates as claimed in claim 9, said method comprising the following steps:

preparing two central panels, comprising a first side and a second side adjacent to the first, for each of said central panels, bending said first side in such a way as to form a first joining panel, said first joining panel comprising a first part, notably a single part, said first part forming an angle (α) with the central panel ($A_0$; $B_0$), optionally, for each of said central panels, bending said second side in such a way as to form a second joining panel, said second joining panel comprising a first part, notably a single part, said first part forming an angle β with the central panel, arranging the two heat exchanger plates in such a way that their first joining panels face one another and that their central plates are parallel to one another, joining the two heat exchanger plates in such a way as to form a pair of plates, the space between the two plates forming a first fluid canal, and mechanically fastening the two plates along their first joining panels.

16. A method for manufacturing a stack of pairs of heat exchanger plates as claimed in claim 10, said method comprising the following steps:

preparing at least four central panels, comprising a first side and a second side adjacent to the first, for each of said central panels, bending said first side of the central panel in such a way as to form a first joining panel, said first joining panel comprising a first part, notably a single part, said first part forming an angle with the central panel, optionally, for each of said central panels, bending said second side in such a way as to form a second joining panel, said second joining panel comprising a first part, notably a single part, said first part forming an angle β with the central panel, arranging the two heat exchanger plates in pairs in such a way that their first joining panels face one another and that their central plates are parallel to one another, joining the heat exchanger plates in such a way as to form at least two pairs of plates, the space between the two plates forming a first fluid canal, mechanically fastening the two plates of each pair along their first joining panels, stacking the at least two pairs of plates, the space between the pairs of heat exchanger plates forming a second fluid canal, and optionally, mechanically fastening the two pairs of plates along their second joining panels.

17. The heat exchanger plate (A; B) as claimed in claim 1, wherein said central panel is quadrilateral or quadrilateral with truncated corners.

18. The stack of pairs of heat exchanger plates (A, B) as claimed in claim 10, wherein said first pair and said second pair are arranged parallel to one another, and the space between the first and second pairs of heat exchanger plates forms a second canal to receive a second fluid flow, and wherein said second pair is identical to said first pair or said second pair is a mirror image of said first pair.

19. The stack of pairs of heat exchanger plates (A, B) as claimed in claim 11, forming a second canal to receive a second fluid flow, wherein said two successive spaced-apart pairs are connected at the sides by closure (C; D), wherein said closure comprising an edge bar, a C-profile or U-profile cover plate, or a flat cover plate of hexagonal or pentagonal shape.

20. A heat exchanger plate (A; B) comprising a central panel ($A_0$; $B_0$) with at least four sides ($A_1$, $A_2$, $A_3$, $A_4$; $B_1$, $B_2$, $B_3$, $B_4$), wherein:

a first side ($A_1$; $B_1$) of the central panel is inclined with respect to said central panel ($A_0$; $B_0$) and forms a first joining panel ($J_A$; $J_B$), the opposite side ($A_3$; $B_3$) to said first side ($A_1$; $B_1$) is flat, a second side ($A_2$; $B_2$) of the central panel ($A_0$; $B_0$) is inclined with respect to the central panel, said second side being adjacent to the first side ($A_1$; $B_1$) and said second side forms a second joining panel ($K_A$; $K_B$) inclined in the opposite direction with respect to the first joining panel ($J_A$; $J_B$), the opposite side ($A_4$; $B_4$) to said second side ($A_2$; $B_2$) is either flat or inclined in such a way as to form a third joining panel, said third joining panel being a mirror image of said second joining panel.

* * * * *